US006659163B2

(12) United States Patent
Agustin

(10) Patent No.: US 6,659,163 B2
(45) Date of Patent: Dec. 9, 2003

(54) METHOD FOR METAL CASTING IN GREEN-SAND MOLDS AND CASTING GUTTER SEALING DEVICE

(75) Inventor: Arana Eraña Agustin, Vitoria (ES)

(73) Assignee: Loramendi, S.A., Vitoria (ES)

( * ) Notice: Subject to any disclaimer, the term of this patent is extended or adjusted under 35 U.S.C. 154(b) by 0 days.

(21) Appl. No.: 10/124,691

(22) Filed: Apr. 15, 2002

(65) Prior Publication Data

US 2002/0129920 A1 Sep. 19, 2002

Related U.S. Application Data

(63) Continuation of application No. PCT/ES00/00013, filed on Jan. 17, 2000.

(30) Foreign Application Priority Data

Oct. 15, 1999 (WO) ..... PCT/ES99/00332

(51) Int. Cl.[7] ..... B22D 37/00
(52) U.S. Cl. ..... 164/135; 164/337
(58) Field of Search ..... 164/133, 134, 164/135, 136, 335, 336, 337

(56) References Cited

U.S. PATENT DOCUMENTS 3,905,419 A 9/1975 Tenner

FOREIGN PATENT DOCUMENTS

| | | |
|---|---|---|
| DE | 197 20 183 | 11/1998 |
| EP | 0 269 591 | 6/1988 |
| EP | 0 894 557 | 2/1999 |
| EP | 0 760 723 | 3/1999 |
| EP | 0 941 789 | 9/1999 |
| EP | 0 951 956 | 10/1999 |
| EP | 0 878 252 | 6/2001 |
| ES | 2 132 138 | 9/1994 |
| ES | 2143391 | 5/2000 |
| JP | 57-25276 | * 2/1982 |
| WO | 98/45069 | 10/1998 |

* cited by examiner

*Primary Examiner*—Kuang Y. Lin
(74) *Attorney, Agent, or Firm*—Katten Muchin Zavis Rosenman

(57) ABSTRACT

The method relies on the simultaneous filling of mold (1) from its bottom through main casting gutter (3) and rising of molten metal (2) in a secondary gutter (6) which branches off from the start of casting gutter (3), with said molten metal (2) rising in secondary gutter (6) in the same amount as in mold (1), so that when the latter is full the main casting gutter (3) is sealed and feeding from the secondary gutter (6) continues, causing it to overflow and fill the corresponding feed head (5) provided on top of mold (1), with secondary gutter (6) communicating at the top with said feed head (5) so that once said feed head is full secondary gutter (6) is sealed. In this manner, the most liquid metal will reach the top part of mold (1) and may be fed to it to compensate contraction of the metal as it cools. A further object of the invention is the device (7) which seals the main casting gutter (3) and the secondary gutter (6), with these two sealing devices (7) being identical and independent.

11 Claims, 10 Drawing Sheets

METHOD FOR METAL CASTING IN GREEN-SAND MOLDS AND CASTING GUTTER SEALING DEVICE

This application is a continuation of international application number PCT ES00/00013, filed Jan. 17, 2000.

OBJECT OF THE INVENTION

The object of the invention relates to a method for metal casting in green-sand molds, designed so that, while the mold is filled on the inside with the molten metal through the corresponding main casting gutter, there is a simultaneous filling of a secondary critical gutter placed outside the mold, which communicates with the top of said mold, specifically with the reservoir area known as the feeding head, so that once the mold is full the main casting gutter is sealed and immediately after this said feeding head is filled, and thereby the molten metal in said head compensates the contraction of the metal as it solidifies.

A further object of the invention is the sealing device for the main casting gutter, which is also used in the secondary feeding head gutter, with a first closing or sealing of the main casting, gutter when the mold has been filled with molten metal and later sealing of the secondary gutter when the feeding head is filled, all of this being controlled by a probe which detects the filling level of the mold and the feeding head. The aforementioned gutters are sealed by cutting off the sand of the mold and the casting gutter without displacement of sand.

BACKGROUND OF THE INVENTION

There are well-known processes for obtaining metal parts by casting on sand molds or burrs in which after the burrs are obtained these move along a transportation system and are placed in correspondence with the filling station, which consists of a top closing plate, side plates and a gas evacuation and extraction system, all such that in first place the casting ladle is pressurised and with this the mold is filled, and then the gases contained in the mold cavities are extracted using an evacuation system, so that once the mold is full the inlet gutter for the molten metal is closed and the ladle is depressurised. After these operations are performed and after the mold inlet gutter cools, said mold is removed with the cast metal and a new filling cycle may begin with the next mold.

These molds generally incorporate on their top a feeding head or reservoir which is also filled with molten metal, so that when the metal cools and solidifies there is an amount of reserve metal to compensate the contraction, and thus without this feeding head and the extra supply of molten metal which it provides the part would present surface irregularities and therefore poor quality parts would be produced.

Also known is that in these type of molds the molten metal is poured or fed at the bottom of the mold, so that the feed head is placed at its top.

It has been found that when the hot molten metal is fed on the bottom the mold is filled with molten metal at the bottom, while as the metal approaches the top it is progressively colder, and thus at the very top of the mold, that is at the feed head, the metal is coldest and will therefore solidify first. However, it would be desirable to have the most liquid metal in the feed head so that the metal required call be fed as the metal contracts inside the mold.

One installation for metal casting in green-sand molds is described in Spanish invention patent n° 9800071 held by this film, which includes a system for sealing or closing the casings gutter comprising a piston driven by a cylinder, with the piston having, ail inner chamber in which a liquid is made to flow, thereby cooling the end and causing a quick solidification of the casting gutter and thus its sealing.

Another method for sealing or closings the casting gutter is described in European Patent no. 0760723, by Georg Fischer Deisa, in which several embodiments are cited for the closings system, one of which consists of a plate with a central orifice which during pouring of the molten metal on the mold is positioned at the inlet gutter, allowing molten metal to pass. After pouring finishes said plate is moved and the inlet gutter closed.

However, this embodiment of a seal has the drawback in that the plate must be preassembled on the mold before casting, which assembly must be very precise so that the plate orifice is aligned with the inlet gutter.

Said European Patent describes, among others, a sealing or closing system based on a piston which is inserted after the casting finishes in a side of the mold, displacing an amount of sand which blocks said inlet gutter.

However, this system has two serious drawbacks, one of which is that a notch must be made on each mold to act as a mark for the insertion of the piston in the collect spot, and the other is that the sealing is achieved by displacement of sand, which in all cases undesirable.

DESCRIPTION OF THE INVENTION

With the method object of the invention the drawback caused by cooling of the molten metal at the top of the mold in order to fill said mold is solved, while with the sealing or closing device for the casting gutter the sand displacement problems and the other problems mentioned in the previous section are also solved.

More specifically, the method metal casting in green-sand molds according to the object of the invention is characterised in that the main casting gutter through which molten metal is fed to the bottom of the mold is prolonged in a secondary vertical gutter on the outside of the mold, which branches from said main casting gutter before reaching the mold, so that as the mold is filled the secondary gutter is also filled by an effect of vessels in communication, with a height of molten metal equal to that in the mould as it is filled, and so that this secondary vertical gutter communicates with the mold at the top of said mold, specifically at the reservoir known as the feed head.

In this manner, as the mold is filled the main feeding gutter is blocked and thus the molten metal reaches the feed head through the secondary vertical gutter, after which the secondary channel is also blocked for a simple recovery under gravity of the molten metal which remains in the secondary gutter and in the main inlet gutter.

Filling of the mold and the feed head is controlled by a probe placed at the top area, which probe may move, i.e. it is retractable, so that it may occupy three positions, two corresponding to a greater or lesser insertion in the top of the mold to detect its filling and that of the feed head, and a third fully retracted position to allow insertion and removal of the sand mold, such that the probe sends the corresponding signals to the devices which seal the main and secondary casting gutters, causing their activation and the ensuing sealing of these gutters.

The sealing device is the same in both cases, although they are independent, and in each case it is opposite the corresponding gutter, in one case opposite the main casting gutter and in the other opposite the secondary gutter for films of the feed head. The device consists of a channel closing strip blade which cuts the sand of the mold and the casting gutter exactly when the mold is filled, without any displacement of sand.

The strip blades, instead of being mounted on the mold as in traditional systems, are mounted on an automatic loading clip outside the mold which can be placed under the machine itself or on its side, somewhat inclined to allow the ejection of each strip blade, with said ejection performed by the impulse of an element which is part of the piston of a pneumatic and hydraulic cylinder, preferably an impact cylinder, which comprises an impulse system which drives the piston or head and with it the element which in turn must push the strip blade at the front of the loading clip, so that said strip blade crosses the sand of the mold in the casting gutter and thereby seals it automatically.

Naturally, strip blades in the loading clip are constantly pressed on by an internal elastic element such as a spring which ensures that the first strip blade is always opposite the outlet of the clip.

Strip blades are as thin is possible, so that thee resistance to their penetration in the sand is small, and thus to improve their stiffness they preferably have an angular jagged profile either wavy or rectangular, which further allows use of thin plates and very sturdy and efficient impact mechanisms which improve penetration.

When the casting is performed with aluminium blades will preferably be of the same material, so that the aluminium alloy is not contaminated when recasting the return of the casting gutters. If a casting material is used with a higher melting, point the strip blades will preferably be made of steel.

The operational stages of the system of the invention may be summarised as follows:

- The casting furnace is approached to the mold and the probe is placed in its position of maximum insertion in the mold.
- The furnace is pressurised an( the mold filled with molten metal through the main gutter or inlet, until the level inside the mold reaches the height set by the probe. At the same time the molten metal in the secondary gutter reaches the same height as inside the mold.
- The casting gutter or main inlet is closed or sealed with the corresponding sealing device.
- The probe rises until it reaches the second measurement position, corresponding to the top level of the feed head.
- Feeding of molten metal continues, only through the secondary gutter as the main feeding gutter has been previously sealed, until the molten metal reaches the level of the new position of the probe.
- The probe generates a signal to cut off supply of the metal, activating the cut-off and sealing of the secondary gutter by the corresponding sealing device, which as mentioned before is identical to that which seals the casting gutter or main inlet.
- The furnace is depressurised so that the liquid metal which remains in the main and secondary casting gutters returns to the furnace. Simultaneously the probe exits the furnace and occupies its fully retracted position so that the mold may be changed.
- The furnace recedes.
- A new mold advances.
- A new cycle begins.

With this method and the operational stages described above, parts are obtained with a better quality than those obtained by traditional systems, as the hottest and therefore more liquid metal is at the top of the mold, and thus feeding from the feed head is improved and the volume and weight of the feed head is reduced.

Furthermore, the ratio of the total weight of metal used to the weight of the past obtained improves considerably.

DESCRIPTION OF THE DRAWINGS

The description and characteristics of the present invention will be understood better in view of the accompanying drawings of a preferred embodiment, in which for purposes of illustration only mid in no way meant as a definition of the limits of the invention the following is shown.

PREFERRED EMBODIMENT OF THE INTENTION

Figure 1:
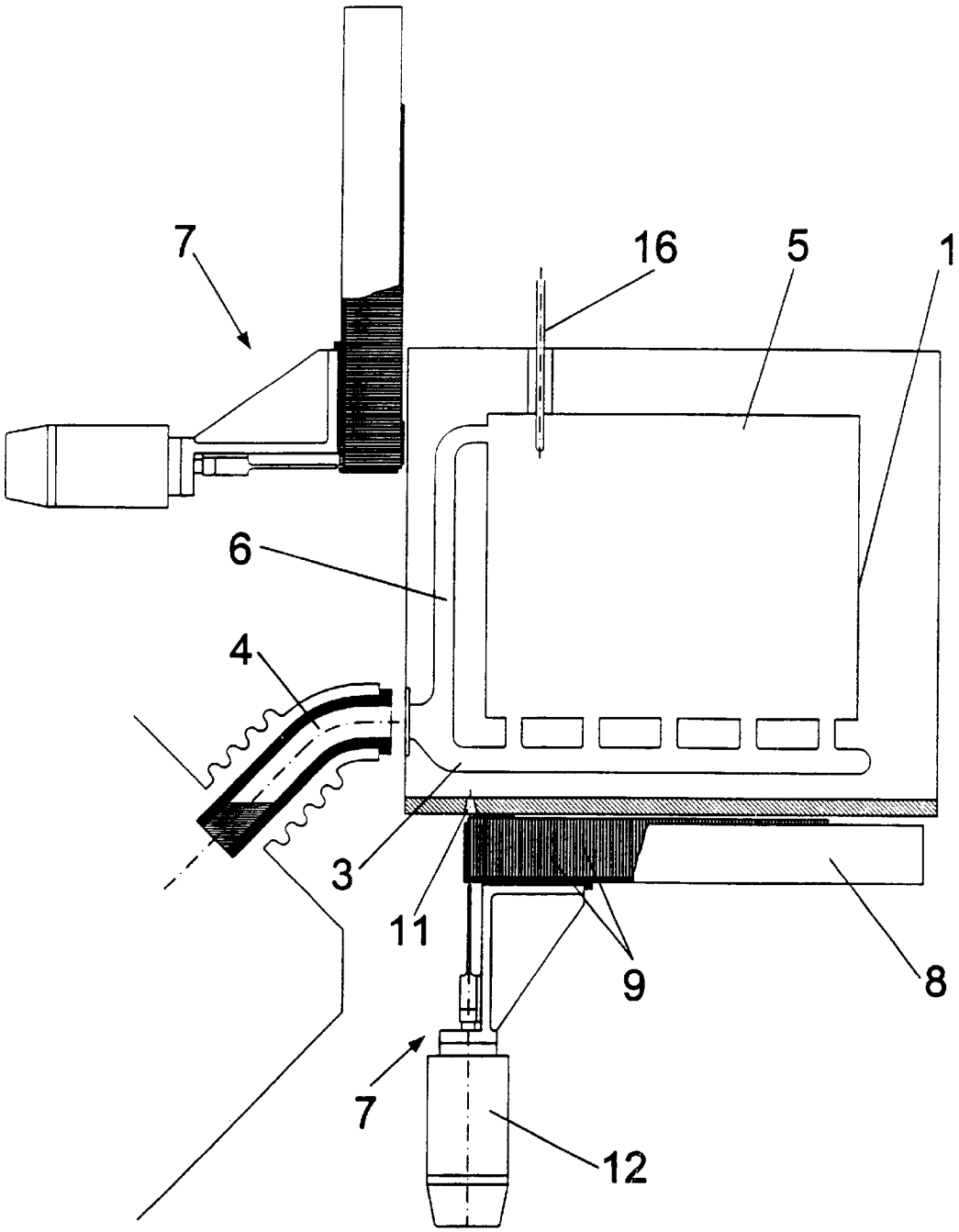
FIGS. 1 to 7 show the various casting operations, as well as the sealing of the main and secondary casting gutters, according to the method of the invention and the sealing device which is part of this invention.

FIGS. 1 to 7 show a mold (1) meant to be filled with a molten metal (2) through a main casting gutter (3) to which is coupled the outlet (4) of a pressurised ladle. The main casting gutter (3 ) is placed at the bottom of mold (1), so that the latter is filled with the molten metal (2) from the bottom upwards, with the uppermost area provided with a reservoir cavity or feed head (5) in communication with a secondary gutter (6) which branches vertically from the start of the main casting gutter (3), with this secondary gutter (6) placed vertically and externally to the mold (1) as clearly seen in the corresponding figures.

Figure 2:
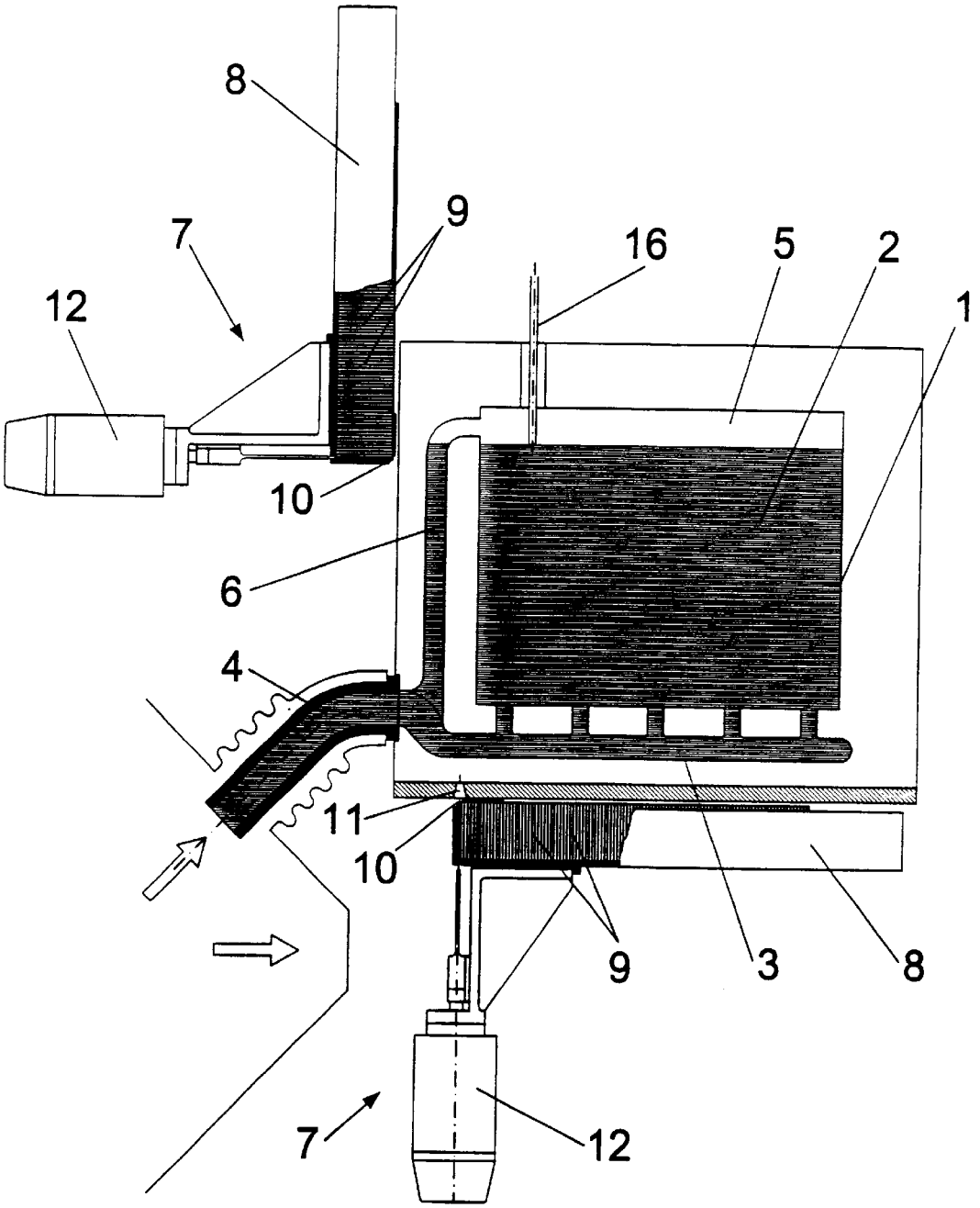
Figure 3:
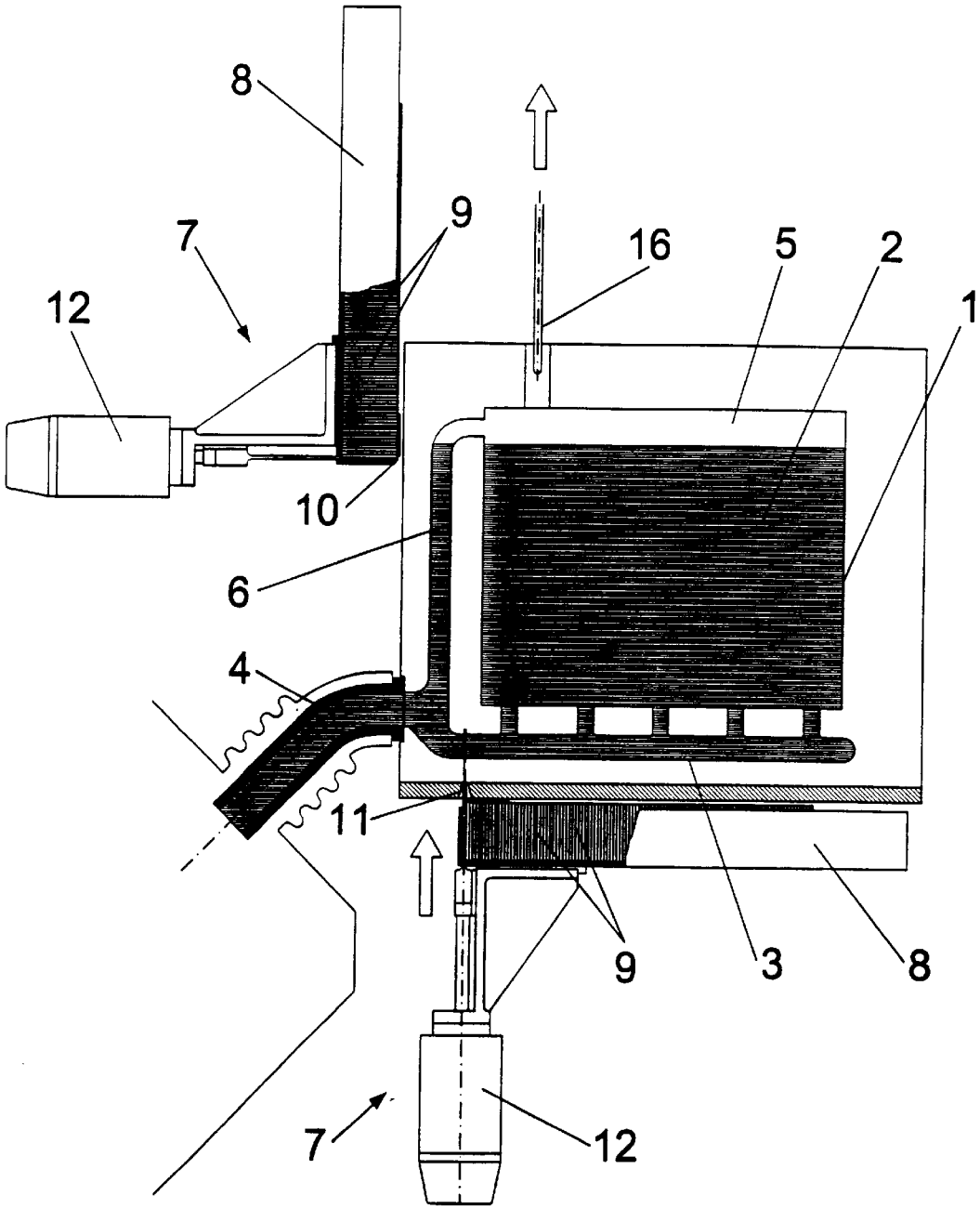
Figure 4:
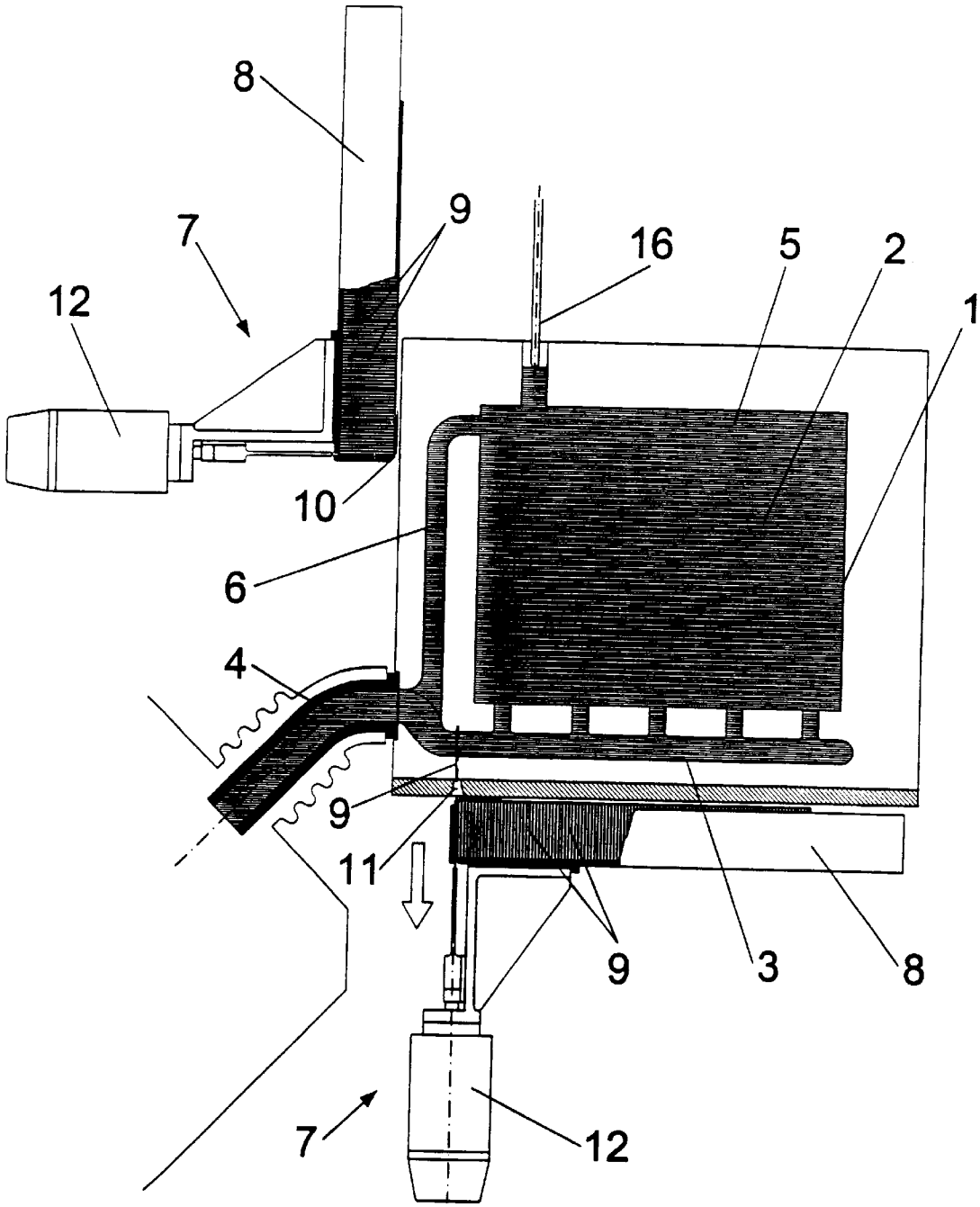
Figure 5:
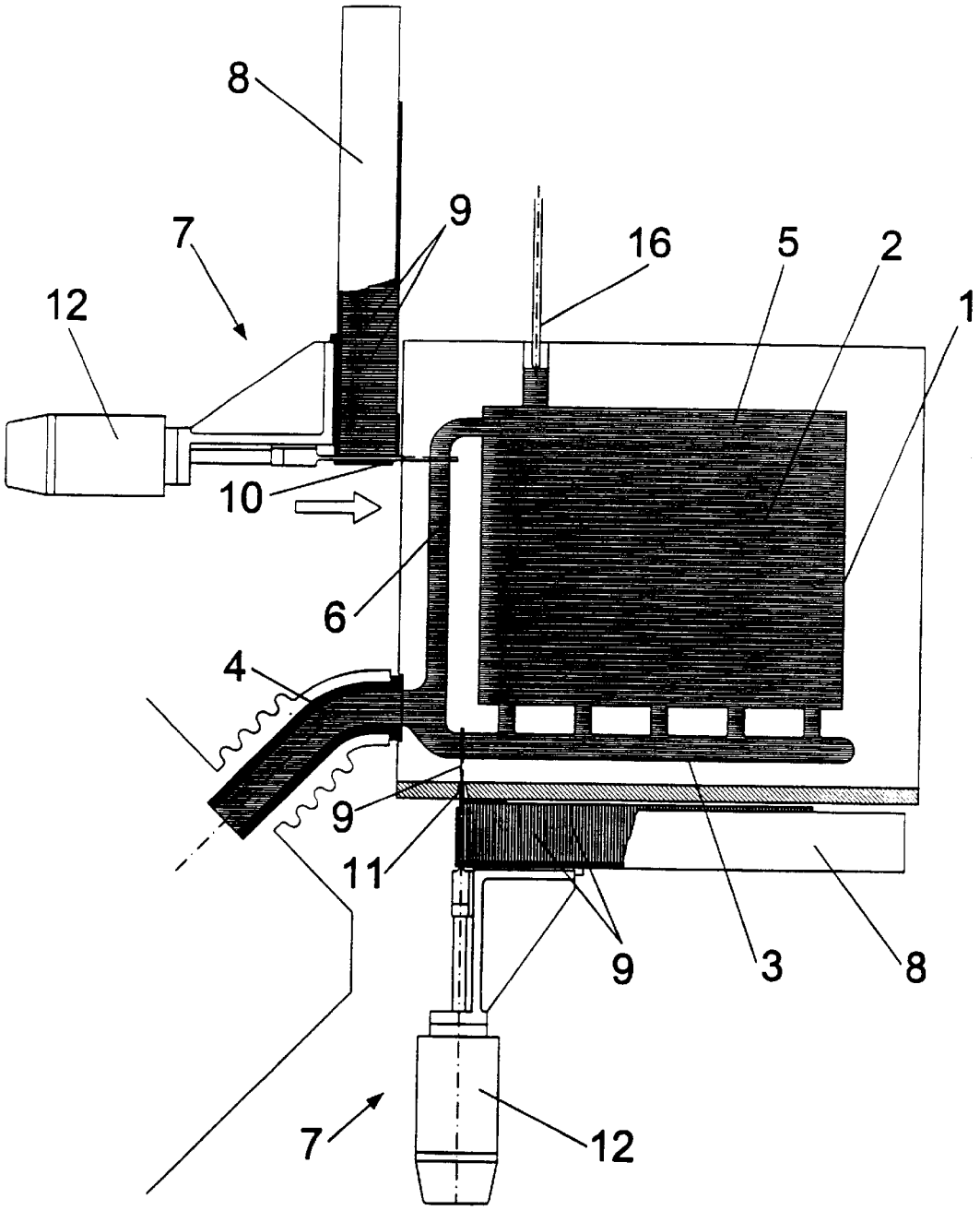

In this manner and as seen specifically in FIG. 2, as mold (1) is filled with molten metal (2), the liquid or molten metal rises to the same height by a communicating vessel effect in the conduct which forms the secondary gutter (6).

Figure 6:
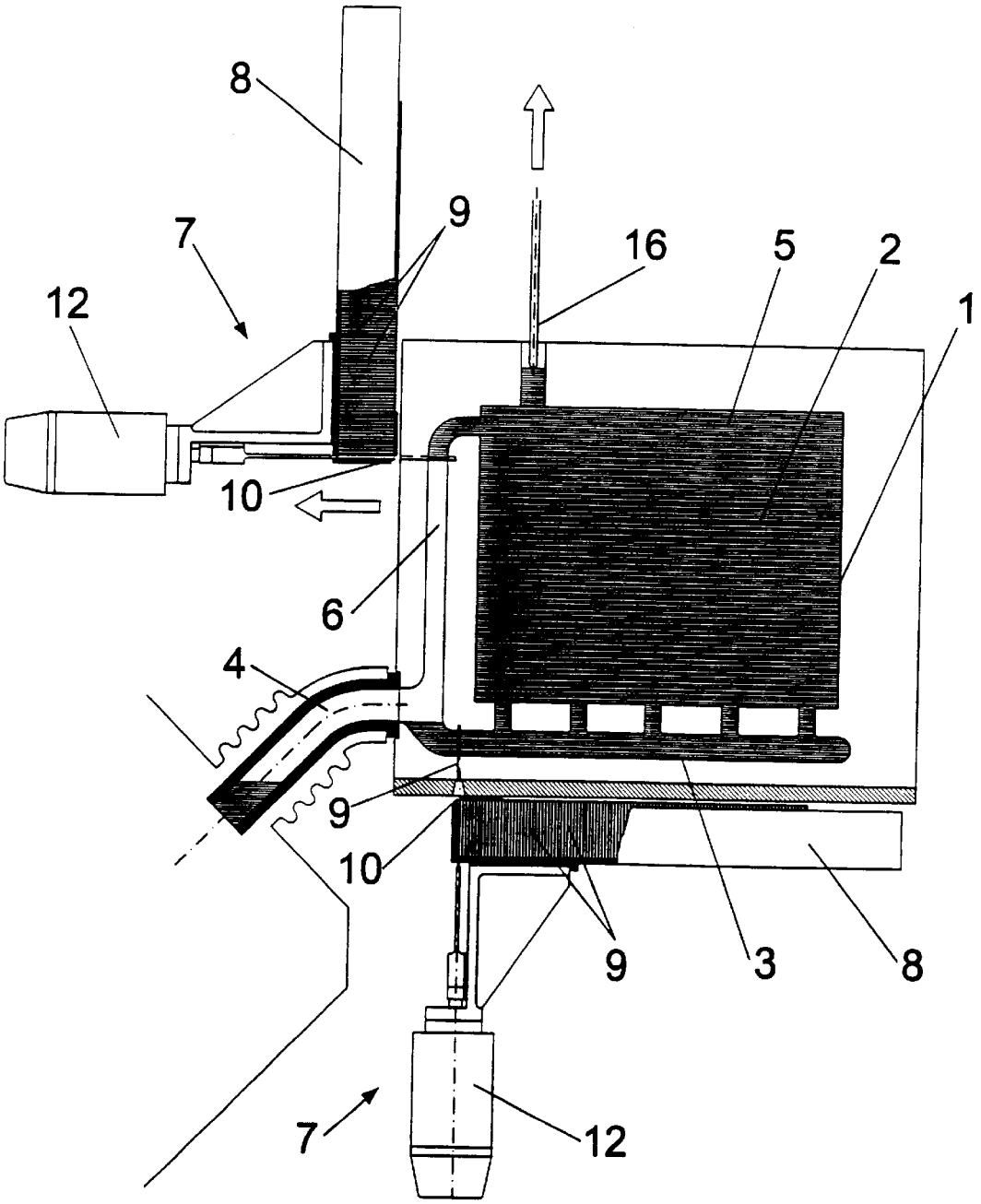
Figure 7:
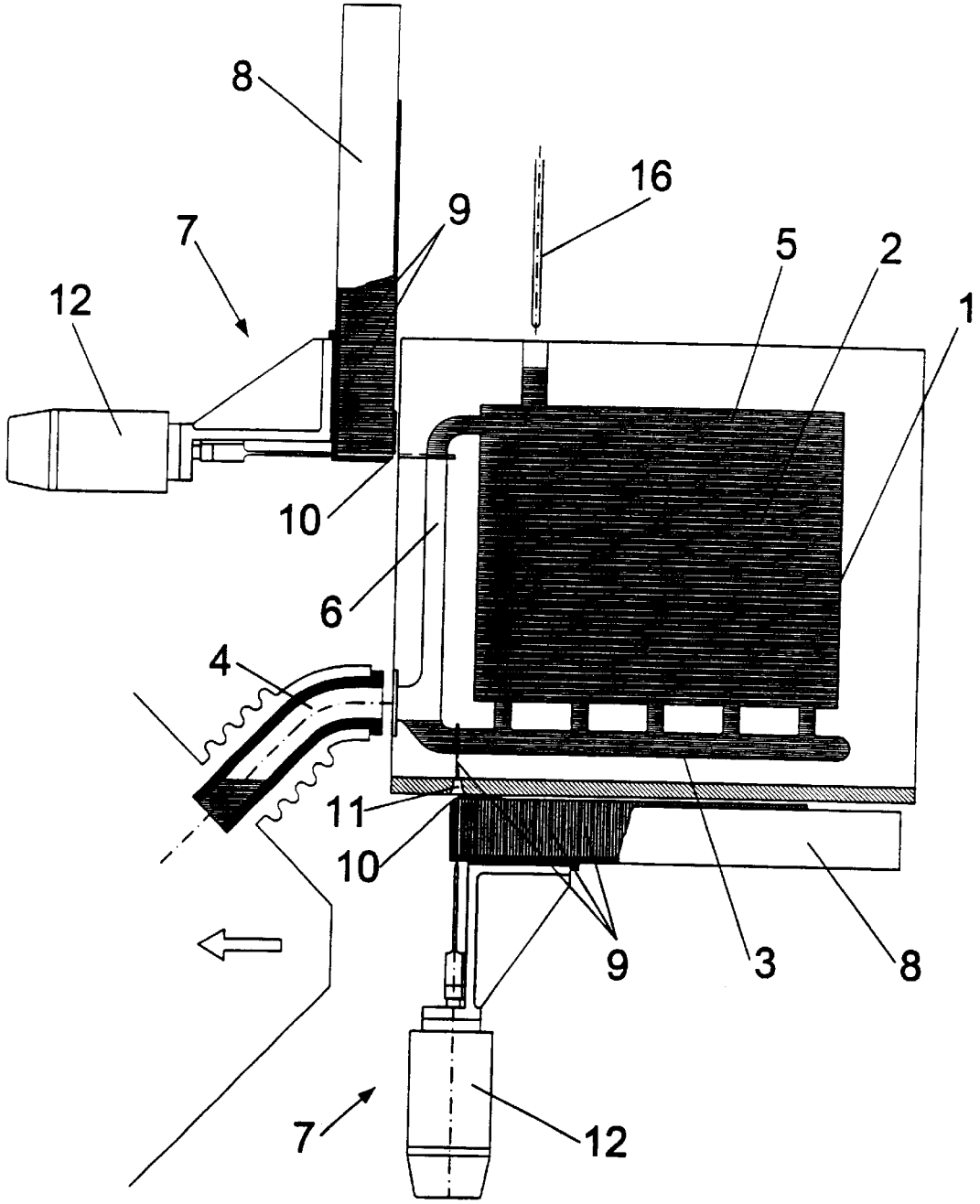
Figure 8:
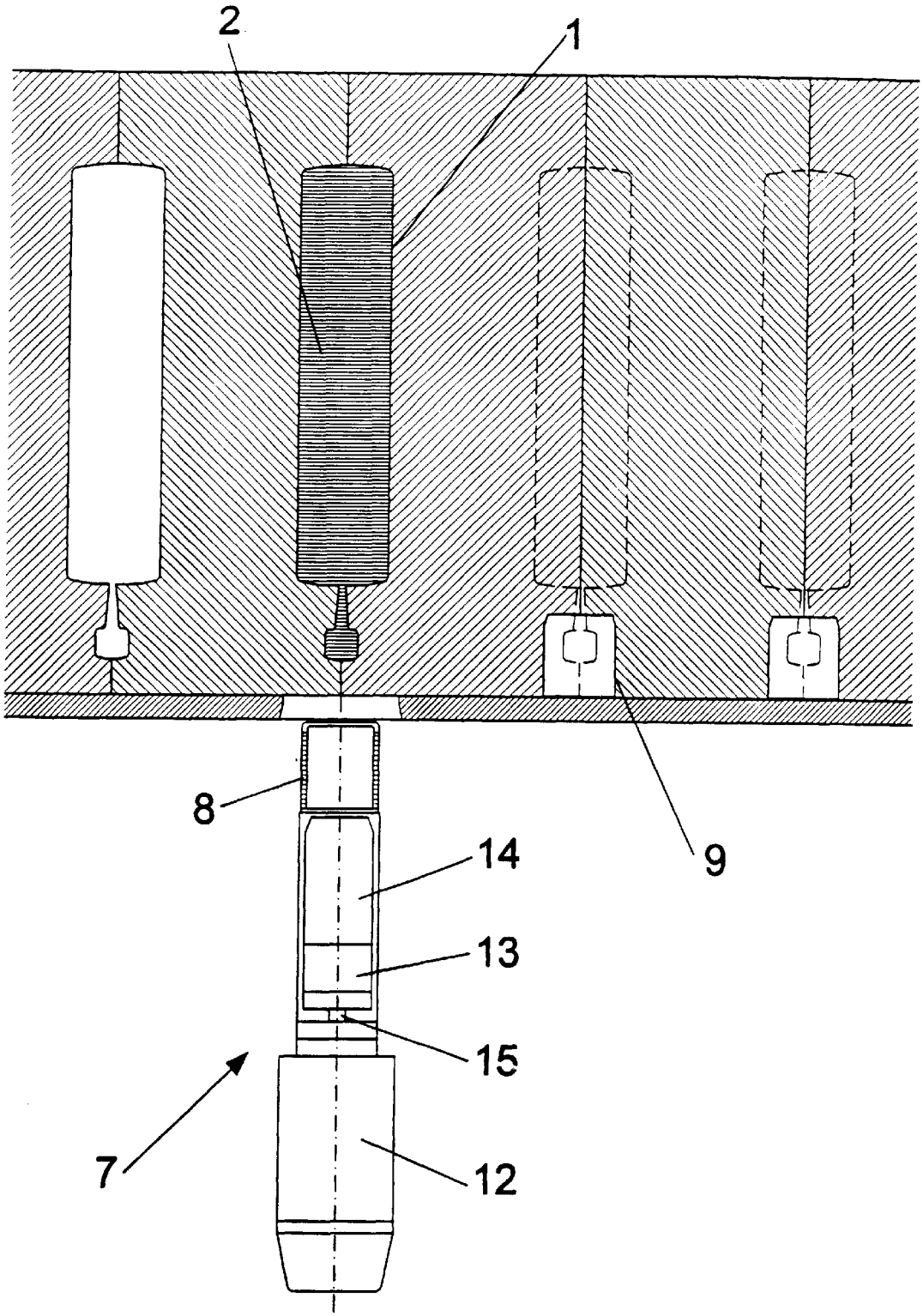
FIG. 8 shows a front view of the sealing device used in the casting method represented in the previous figures.
Figure 9:
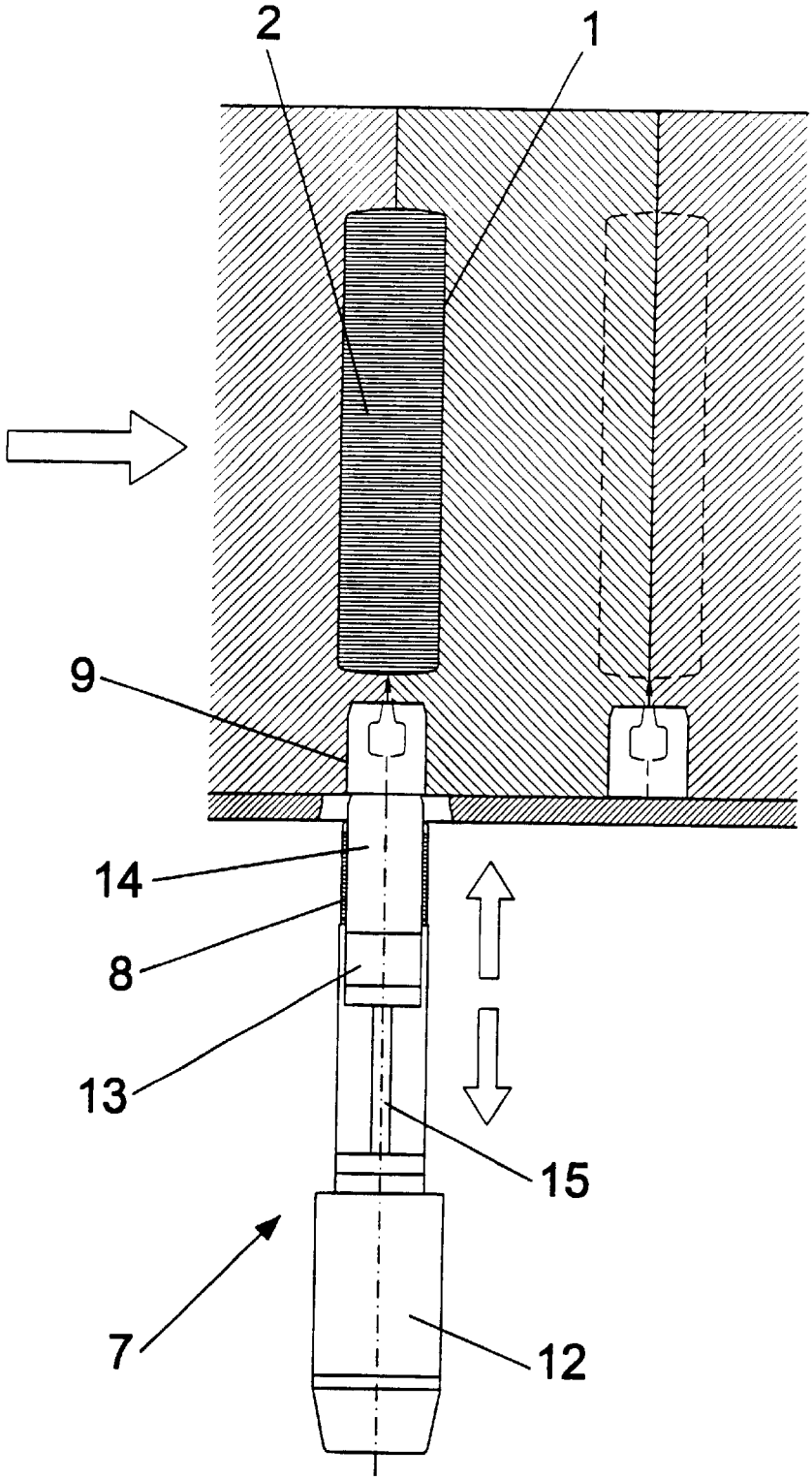
FIG. 9 shows a view similar to that of the previous figure with the sealing device activated and therefore with the strip blade cutting off or sealing the main casting gutter of the mold.

After mold (1) is filled with molten metal (2) it is sealed, so that if metal is continued to be fed as it cannot pass through main casting gutter (3) the metal will fill feed head (5), and once the latter is full the secondary gutter (6) is sealed for recovery of all excess liquid metal, as seen in FIGS. 6 and 7.

The sealing of both the main gutter (3) and the secondary gutter (6) is performed by corresponding, sealing devices (7) which are identical to each other, the first arranged vertically and the second horizontally, although they may be arranged inclined as mentioned before. This sealing device comprises an automatic loading clip (8) which contains a number of strip blades (9) which are constantly pushed towards an end of said clip (8), where a lateral outlet (10) is provided opposite a slot (11) made in the bottom of the installation which includes mold (1). Said clip (8) is connected to a drive cylinder, also pneumatic or hydraulic, with a head (13) at the end of its corresponding piston or shaft (15), which head (13) is prolonged in a pusher (14) which acts on strip blade (9) placed opposite outlet (10), all of this such that with the sealing device (7) assembly arranged as represented in FIGS. 1 to 9, that is under the machine or on its side, and after mold (1) is filled, cylinder (12) is activated and with it head (13) is impelled together with its pusher (14), which passes through clip (8) to push on the first strip blade (9), which will cut the sand of the mold and casting gutter (3), thereby sealing it.

After this operation the final filling, of feed head (5) takes place, which gives rise to the activation of sealing device (7) placed on a side and which must seal secondary gutter (6() in the same way as that described above.

Control and regulation of the two sealing devices (7) and therefore of strip blades (9) is provided by a probe (16) which can detect the moment at which mold (1) is full and the moment at which feed head (5) is full, for which purpose the probe is retractable, capable of moving upwards and downwards, so that it may occupy three different positions. Two of these positions correspond to measurement position in which the probe is introduced in the mold to a greater or lesser extent and the third is a total retraction situation as shown in FIG. 7, which allows to introduce and remove mold (1).

Figure 10:
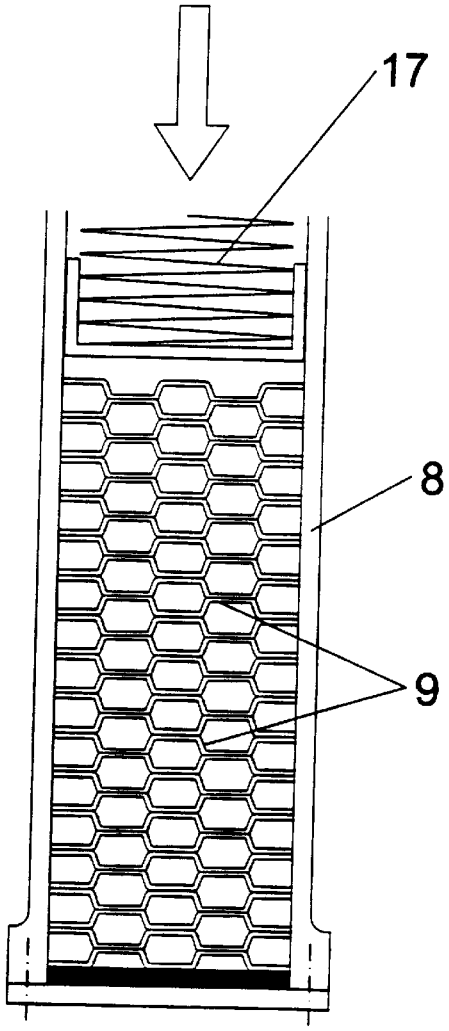
FIG. 10 shows a sectional view of an example of a loading clip for the strip blades used as sealing, elements in the device shown in the two previous figures.
Figure 11:
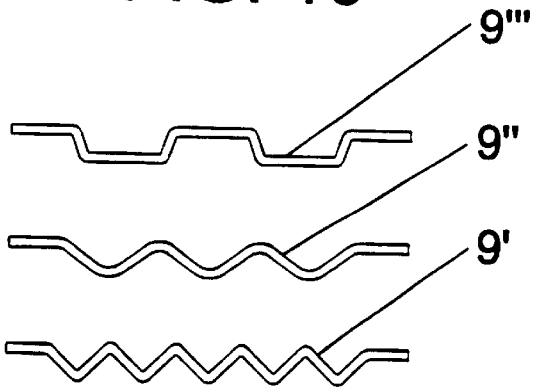
FIG. 11 shows, finally, a view of several possible arrangements or shapes for the strip blades.

FIG. 10 shows clip (8) with strip blades (9) pushed by a plastic element, such as a spring (17) or the like while FIG. 11 shows three arrangements or shapes for the profile of as many strip blades labelled (9'), (9") and (9"'), in which three cases the profile is jagged, with an angled, wavy or rectangular shape respectively, in all cases forming a highly resistant and stiff structure which allows the use of powerful and sturdy cylinders or drive elements (12).

What is claimed is:

1. Method for metal casting in green-sand molds, applicable in machines used for filling sand molds with metals, with the corresponding sealing of a main casting gutter after filling a mold having a top part and a bottom part with molten metal which is fed at the bottom part of the mold, comprising:

providing in addition to the main casting gutter a secondary gutter which is vertical and external to mold;

communicating said secondary gutter to the top part of mold in which is provided a corresponding feed head for said mold;

making one part of the molten metal gradually fill the mold and another part of said molten metal simultaneously rise in the secondary gutter;

achieving scaling of the main casting gutter once rho mold is filled with molten metal, with the feeding of the molten metal continuing through the secondary gutter until filling the feed head at the top of the mold.

2. Method for metal casting in green-sand molds, as claimed in claim 1, wherein the secondary gutter is a vertical extension which branches from the main casting gutter at its beginning, before the main earning gutter enters mold.

3. Method for metal casting in green-sand molds, as claimed in claim 1, characterised in that means are provided for detecting the filling of mold (1) and the filling of feed head. (5).

4. Method for metal casting in green-sand molds, as claimed in claim 3, wherein the detecting means further comprises a probe mounted to occupy two measurement positions for controlling the filling of the mold and the feed head and a third position retracted from the mold, which probe sends signals for scaling of the main casting gutter and the secondary gutter after the mold and feed head respectively are full.

5. Sealing device for casting gutters in a green-sand mold for use after the mold has been filled, said mold comprising a bottom part, a top part, a main casting gutter, a secondary gutter which is external to the mold and in communication with the top part of said mold, comprising:

a plurality of strip blades provided inside a clip, a cylinder which drives a strip blade from the clip to at least one of the main casting gutter or the secondary gutter, thereby cutting off a feed of metal to the mold and the main casting gutter without displacement of sand.

6. Sealing device for the casting gutter in green-sand molds, as claimed in claim 5, wherein the strip blades are thin and have a jagged angular profile.

7. Sealing device for the casting gutter in green-sand molds, as claimed in claim 5, characterised in that the sealing device set (7) which comprises the loading clip with its strip blades (9) and driving cylinder (12), is independent of mold (1); such that strip blades (9) contained in automatic loading clip (8) are constantly pushed while in the clip by an elastic element such as a spring (17) or the like towards one of the ends of said clip (8), on the end of which clip is a lateral outlet (10) for each strip blade (9) which must seal the main casting gutter (3) or the secondary gutter (6), while driving cylinder (12) which can be both hydraulic or pneumatic, preferably an impact cylinder, has a head (13) associated to its corresponding piston (15), which head (13) is prolonged as an element (14) which upon activation of cylinder (12) inserts laterally in loading clip (8) to push the first strip blade (9) and cause it to exit through outlet (10), thereby placing it in the main casting gutter (3) or in the secondary gutter (6).

8. Sealing device for the casting gutter in green-sand molds, as claimed in claim 5, wherein the strip blades have a wavy profile.

9. Sealing device for the casting gutter in green-sand molds, as claimed in claim 5, wherein the strip blades have a rectangular profile.

10. Sealing device for the casting gutter in green-sand molds, as claimed in claim 5, wherein the strip blades are made from aluminum.

11. Sealing device for the casting gutter in green-sand molds, as claimed in claim 5, wherein the strip blades are made from steel.

* * * * *